US007246380B2

(12) United States Patent
Gardner et al.

(10) Patent No.: US 7,246,380 B2
(45) Date of Patent: Jul. 24, 2007

(54) PROTECTIVE GARMENT WITH REPAIRABLE INTEGRATED VISIBILITY-ENHANCING FEATURES

(75) Inventors: Timothy J. Gardner, Saint Paul, MN (US); Robert L. Jensen, Jr., Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 539 days.

(21) Appl. No.: 10/353,630

(22) Filed: Jan. 29, 2003

(65) Prior Publication Data

US 2004/0143882 A1 Jul. 29, 2004

(51) Int. Cl.
*A41D 13/00* (2006.01)

(52) U.S. Cl. ..... 2/69; 2/81

(58) Field of Classification Search ..... 2/69, 2/81, 82, 87, 93, 97, 904, 22, 23, 59, 125, 2/126, 244, 268, 269, 270, 275; 428/161, 428/164, 325; 359/529–533, 833, 834; 19/236, 258, 260, 261, 266, 267, 271, 272, 19/273, 278, 294, 295
See application file for complete search history.

(56) References Cited

U.S. PATENT DOCUMENTS

| | | | | |
|---|---|---|---|---|
| 1,234,608 | A * | 7/1917 | Berkwits | 2/93 |
| 3,787,897 | A | 1/1974 | Sabin et al. | |
| 3,837,007 | A * | 9/1974 | Girest | 359/519 |
| 4,533,592 | A | 8/1985 | Bingham | |
| 4,651,355 | A | 3/1987 | White | |
| 4,815,146 | A * | 3/1989 | Theewis et al. | 2/94 |
| 4,817,210 | A * | 4/1989 | Aldridge et al. | 2/81 |
| 5,010,597 | A | 4/1991 | Glover | |
| 5,095,549 | A | 3/1992 | Aldridge | |
| 5,153,941 | A | 10/1992 | Grilliot et al. | |
| 5,613,247 | A | 3/1997 | Bowman | |
| 5,695,853 | A | 12/1997 | Billingsley et al. | |

(Continued)

FOREIGN PATENT DOCUMENTS

| | | |
|---|---|---|
| DE | 2153187 | 3/1973 |

(Continued)

OTHER PUBLICATIONS

"Strata Designs Cyberglow Catalogue", [UK online], [retrieved from the internet Jan. 4, 2005], <http://web.archive.org/web/20020605004225/www.cyberglow.co.uk/cgi-bin/acatalog/>, pp. 9.

(Continued)

*Primary Examiner*—Gary Welch
*Assistant Examiner*—Andrew W. Sutton
(74) *Attorney, Agent, or Firm*—Stephen C. Jensen; Jay R. Pralle; Nicole J. Einerson

(57) ABSTRACT

Protective garments such as firefighters' coats and pants are described. The garments have an outer shell material made from substantially non-overlapping panels stitched together. Some panels are specially designed and reserved for carrying an enhanced visibility material on a majority of their exposed surface area. The enhanced visibility material can be a retroreflective material such as an exposed lens beaded construction, a fluorescent material, or a phosphorescent material. The enhanced visibility panel(s) are stitched to non-enhanced visibility panels so that if damaged, the stitch can be removed and the enhanced visibility panel replaced to repair the garment.

16 Claims, 6 Drawing Sheets

U.S. PATENT DOCUMENTS

| | | | | |
|---|---|---|---|---|
| 5,888,618 | A | 3/1999 | Martin | |
| 6,110,558 | A | 8/2000 | Billingsley et al. | |
| 6,185,742 | B1 | 2/2001 | Doherty | |
| 6,355,302 | B1 | 3/2002 | Vandenberg et al. | |
| 6,735,789 | B2 | 5/2004 | Kelleher et al. | |
| 6,910,222 | B1 * | 6/2005 | Schssler | 2/69 |
| 2002/0016985 | A1 | 2/2002 | Kelleher et al. | |
| 2002/0076534 | A1 | 6/2002 | Sadato et al. | |
| 2003/0019009 | A1 | 1/2003 | Feduzi et al. | |

FOREIGN PATENT DOCUMENTS

| | | | |
|---|---|---|---|
| DE | 3820716 A1 | | 12/1989 |
| FR | 2626446 | | 1/2001 |
| GB | 2351651 | | 10/2001 |
| WO | WO 01/42823 | * | 6/2001 |
| WO | WO 02/103108 | * | 12/2002 |

OTHER PUBLICATIONS

"ProductFrame", [on line], [retrieved from the internet Apr. 4, 2005], <http://web.archive.org/web/20010803085755/primalwear.com/ProductFrame.html>, pp. 3.

"Turnout Services . . . Fully Compliant Turnout Cleaning & Repair!", [on line], [retrieved from the internet Apr. 4, 2005], <http://web.archive.org/web/19981205104844/http://www.turnoutservices.com>, pp. 4.

* cited by examiner

PROTECTIVE GARMENT WITH REPAIRABLE INTEGRATED VISIBILITY-ENHANCING FEATURES

FIELD OF THE INVENTION

The present invention relates to protective garments such as overcoats and trousers designed for firefighters. More particularly, the invention relates to such garments that incorporate visibility-enhancing features on an outer layer thereof, and methods of making and methods of repairing such garments.

BACKGROUND

Protective outerwear for firefighters must meet particularly stringent requirements. Most fundamentally, such outerwear must be able to withstand intense heat from external sources, but also keep the wearer from getting burned. Thus, firefighters' jackets are commonly constructed with multiple layers: an outer layer or "shell" made of specialized fire-resistant fabric, and at least one inner insulating layer. A breathable liner is also commonly included between the outer shell and the insulating layer to keep liquid water from penetrating the garment while allowing water vapor to escape. The outer shell, insulating layer, and liner are co-extensive throughout the garment. In some garments the insulating layer can be removeable. The garment is furthermore desirably as lightweight as possible to minimize physical exertion of the wearer, and is as flexible as possible to minimize restricting the wearer's freedom of movement.

From these considerations, one can appreciate why such protective garments are highly specialized and expensive. One can also appreciate why it is desirable to extend the useful life of such garments, including in appropriate cases repairing worn garments rather than simply discarding them.

In addition to the requirements discussed above, firefighters' outerwear desirably is provided with visibility-enhancing materials so that the firefighter will be more conspicuous in daytime and/or nighttime lighting conditions. Most commonly these materials are applied in the form of a free-standing polymer- or fabric-backed, ribbon-like trim that is sewn on top of the fire-resistant shell. See, e.g., FIGS. 1 and 2, which depict front and back views respectively of a PRIOR ART fireman's coat 1 with known visibility-enhancing trim material 2 applied thereto by sewing. The trim material 2 includes a fluorescent coating 4 on a fire resistant fabric backing and retroreflective sheeting 6 covering a portion of the material. See U.S. Pat. No. 4,533,592 (Bingham) for further details. Prismatic retroreflective polymer-based trim products that are also fluorescent in daytime conditions are also being sold today for application to firemen's coats. The co-extensive nature of the layers used in PRIOR ART protective garments such as firemen's coats is depicted in FIG. 3, where the outermost layer 8 represents a fire-resistant fabric, middle layer 10 represents a breathable liner, and inner layer 12 represents quilted insulation. In some firecoat designs the outer fire resistant shell is stitched to the inner layer(s), while in others the outer shell is not attached to the inner layers in any way so that either component can be cleaned or replaced separately. Note, however, that certain protective garment designs—for example, wildlands/wilderness standard firefighter garments—consist essentially of only the outer fire-resistant fabric layer, eliminating entirely any inner layers such as the breathable liner and insulation.

Application of known free-standing visibility-enhancing trims to the protective garment achieves the goal of increasing the daytime and nighttime visibility of the wearer. Further, when the visibility-enhancing trim becomes damaged in use, it is known to repair the garment by stripping away any remaining damaged trim material and applying a new piece of trim material in its place, again on top of the outer fire resistant shell of the garment.

But there are also disadvantages associated with this approach of enhancing firefighters' visibility. The added pieces of trim add weight and thickness, and reduce flexibility of the garment. Also, the free edges of the trim adjacent to the stitching may catch or snag on external objects. Even if visibility-enhancing material is applied directly to the outer shell material, when the garment becomes damaged in use it becomes expensive to replace or repair. It would be advantageous to provide the protective garment with the desired visibility-enhancing features, while avoiding one or more these disadvantages.

BRIEF SUMMARY

The present application discloses a protective garment of the type having an outer fabric layer. Rather than having a separate trim product attached over the outer fabric layer, the garment has a visibility enhancing material applied directly and permanently to the outer fabric. Moreover, the garment is readily repairable by virtue of a combination of the physical construction of the outer fabric layer and the placement of the visibility enhancing material on selected portions of the garment.

In particular, the outer fabric layer is composed of a plurality of distinct outer fabric panels connected together in a substantially non-overlapping fashion. At least one of the panels, referred to as a first enhanced visibility panel, includes on most of its working surface a visibility enhancing material or a pattern of such material. The first enhanced visibility panel is stitched to a first non-enhanced visibility panel along respective edges thereof.

The visibility enhancing material can be applied in a pattern that covers at least 75% of the working surface of the first enhanced visibility panel. The pattern can include background portions having no visibility enhancing material, such background portions accounting for at least 25%, or at least 50%, of the pattern. The visibility enhancing material can also be applied, whether patterned or not, to cover at least 50% of the working surface.

The visibility enhancing material, which can be a retroreflective material, a fluorescent material, a phosphorescent material, and combinations thereof, can be applied to the working surface of the first enhanced visibility panel in the form of a thin surface coating or threads (whether individually or in bundles that form yarn) woven into the working surface.

The first enhanced visibility panel can be in the form of an extended strip with opposed first and second edges, and can attach to two separate non-enhanced visibility panels along such edges. The strip can also be formed into a band which may, for example, encircle an extremity member of the garment such as an arm or a leg.

Visibility enhancing material thus can not only be applied directly to outer fabric panels of a protective garment, but such materials can be localized onto specialized high-visibility panels that, if damaged, can be readily replaced with minimal disruption to the remainder of the garment, by simply removing the stitching connecting such a panel to adjacent non-enhanced visibility panels and stitching a replacement high-visibility panel in place.

These and other aspects of disclosed embodiments will be apparent from the detailed description below. In no event, however, should the above summaries be construed as limitations on claimed subject matter, which subject matter is defined solely by the attached claims, as may be amended during prosecution.

BRIEF DESCRIPTION OF THE DRAWINGS

Throughout the specification reference is made to the appended drawings, where like reference numerals designate like elements, and wherein.

DETAILED DESCRIPTION OF THE ILLUSTRATIVE EMBODIMENTS

Figure 1:
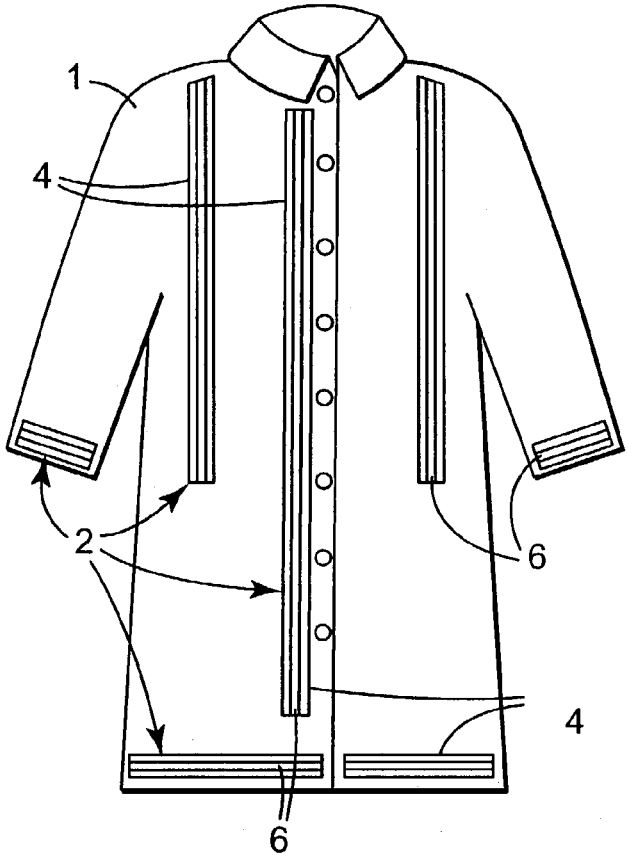
FIG. 1 PRIOR ART
FIGS. 1 and 2 are views of a PRIOR ART fireman's coat as described above.
Figure 2:
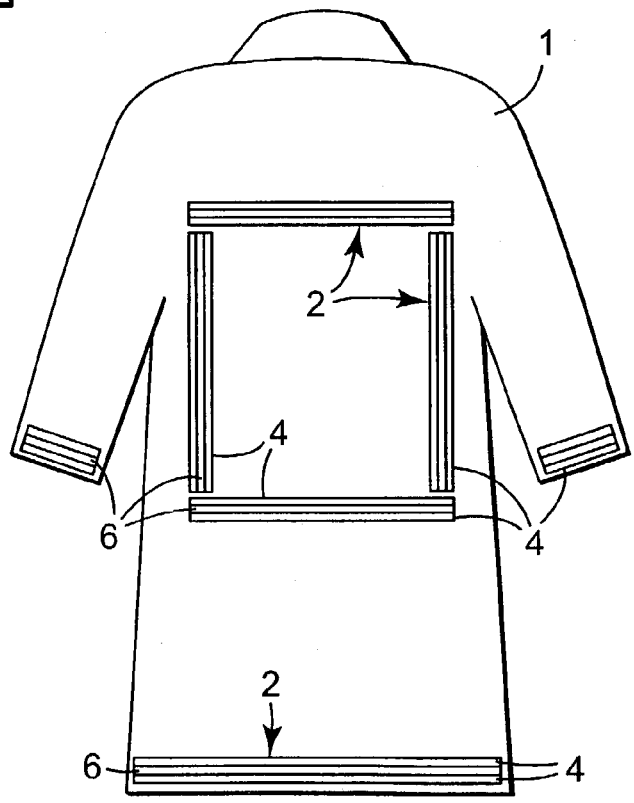
FIG. 2 PRIOR ART
Figure 3:
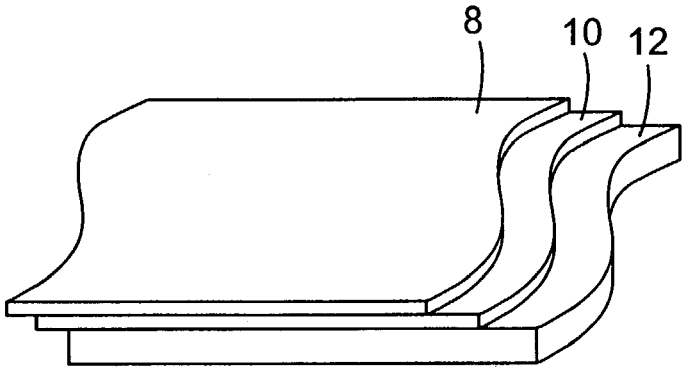
FIG. 3 PRIOR ART
FIG. 3 is a view of multiple co-extensive layers such as are used in some PRIOR ART protective garments, as discussed above.

In one aspect, the techniques disclosed in the present specification take advantage of known design and construction techniques for protective garments for firefighters and the like, which comprise an outer shell fabric and (optionally) at least one co-extensive inner layer. In the known techniques, the garment manufacturer cuts out distinctly shaped pieces ("panels") of the outer shell fabric, and of the other layers that will make up the final garment, from jumbo rolls of the respective materials. For example, some of the panels may be for torso portions of a firefighter's jacket, and other panels may be for the arm portions, collars, or cuffs thereof. These distinct panels are then connected together by conventional sewing techniques to produce the finished jacket. Techniques of the present specification can take advantage of these well established processes by using at least one panel of the outer shell fabric predominantly for visibility-enhancing purposes, i.e., minimally at least about 50% of the exposed surface of the panel on the finished product (referred to as the "working surface" of the panel) has applied thereto a visibility enhancing material. Alternatively, at least about 75%, or even 90% or more, of the working surface has a pattern of visibility enhancing material. Visibility enhancing material can be applied to the entire working surface, whether entirely made of a single type of visibility enhancing material such as retroreflective material, or whether a patterned combination of visibility enhancing materials such as a stripe of retroreflective material adjoining one or two stripes of fluorescent material. Preferably, visibility enhancing material is applied in a discontinuous pattern that includes background portions having no visibility enhancing material. Such background portions, which can account for at least 25% or at least 50% of the pattern, can beneficially preserve the original thermal decay and vapor permeability properties of the outer fabric material. Reference is made to U.S. patent application Ser. No. 09/918,267, "Vapor Permeable Retroreflective Garment", filed Jul. 30, 2001.

The visibility enhancing material is applied permanently and directly to the working surface of the fabric panel. This can be accomplished for example by a thin surface coating or a thread or threads (e.g. in the form of a yarn) woven into the working surface, the coating or the threads incorporating the visibility enhancing material. In either case the directly applied visibility-enhancing material preferably adds only a minor amount to the panel's weight, thickness, and stiffness. With the enhanced visibility panel(s) so modified, the panels are then pieced together such as by stitching in the usual way to produce the finished jacket, with no need to apply any additional visibility-enhancing material such as trim as is done today. The number and size of the enhanced visibility panels are selected to provide the desired coverage (e.g., 0.1 or 0.2 square meters or more) of visibility-enhancing material.

Most typically, the outermost shell is a conventional fire-resistant fabric. Such fabric can be a woven fabric of fire retardant treated 100% cotton, aramid yarns, modacrylic fibers, glass fibers, ceramic fibers, or blends of the foregoing. These fabrics generally have a weight in the range of about 6 to 7.5 oz/yd$^2$ (about 200 to 250 g/m$^2$), and are thermally stable to temperatures of about 400° F. or higher.

One of the possible visibility-enhancing materials is retroreflective material. In general, such materials have the property of reflecting incident light, such as light from a vehicle headlamp, back in the general direction from which the light originated, regardless of the angle at which the incident light impinges on the surface of the material. Thus, a person wearing such a material can be highly visible to drivers of such vehicles at night, depending on the amount of retroreflective material used, and the reflectivity of the material. Generally, reflectivities of at least 10 cd/(lux·m$^2$) are obtained, and more preferably at least 50, 100, or even 500 cd/(lux·m$^2$). Such reflectivities are measured under standard conditions of 0° orientation angle, −4° entrance angle, and 0.2° observation angle. The retroreflectivity can be provided by a multitude of reflective facets arranged as cube corner elements, or, more commonly, by a monolayer of tiny glass beads or microspheres that cooperate with a specularly reflective mirror-like material such as aluminum or a multilayer dielectric stack. In the case of beads or microspheres, the beads are partially embedded in a thin binder layer that holds the beads to the fabric, and are partially exposed to the atmosphere. Incident light enters the exposed portion of a bead and is focused by the bead onto the mirror, which is disposed at the back of the bead embedded in the binder layer, whereupon the light is reflected back through the bead, exiting through the exposed portion in a direction opposite to the incident direction. This type of construction is referred to as "exposed lens", because it uses microspheres with portions that are exposed to the atmosphere. Such a layer of retroreflective beads can be applied continuously over the entire fabric, or in stripes, spots, graphics, or any arbitrary pattern to the fabric. The retroreflective beads contribute to nighttime visibility of the garment wearer. A retroreflective sheeting can also be slit to form a fine thread suitable for direct and permanent weaving into either the entire fabric or portions of the fabric defining a pattern.

Products capable of attaching exposed lens retroreflective beads directly and permanently to a fabric include: 3M™ Scotchlite™ Reflective Material 8710 Silver Transfer Film, available from 3M Company; and 3M™ Scotchlite™ Reflective Material 5720 Silver Graphic Transfer Film, also available from 3M Company. Further, the continuous process disclosed in U.S. Pat. No. 6,355,302 (Vandenberg et al.) is also suitable. Inks containing half-reflectorized beads are also available, and can provide the fabric with retroreflectivity. The beads or microspheres are usually of a glass composition, with diameters from about 20 to 200 μm, more typically about 40 to 120 μm, and have a refractive index of about 1.9. Beads available from 3M Company have a refractive index of about 1.92, an average diameter of about 65 μm, and a barium titanate glass composition of nominally 43.5% $TiO_2$, 29.3% BaO, 14.3% $SiO_2$, 8.38% $NaO_2$, 3.06% $B_2O_3$, and 1.44% $K_2O$. The reflective mirror-like layer is typically but not necessarily aluminum, about 20 to 200 nanometers thick, and can be deposited directly on a submerged portion of each bead. Bead bond materials are selected for their adhesion to both the beads and the particular fabric. Adhesives and curable resins (e.g. a polyester such as Vitel™ 3550, an acrylic latex such as Rhoplex™ HA-8, or phenolic/rubbers) are examples of specific bead-bond materials.

Another possible visibility-enhancing material is fluorescent material. Such materials provide vivid fluorescent colors when exposed to blue or ultraviolet light commonly provided by sunlight. A fluorescent pigment marketed as DayGlo™ GT17, for example, provides a yellow fluorescent color when illuminated by shorter wavelength radiation. Similar conventional pigments are available that provide red, orange, red/orange, and lime green fluorescent color used in trims or other sheeting products, and can also be used in the embodiments disclosed herein. Such fluorescent materials contribute to the daytime visibility of the garment wearer.

Still another possible visibility-enhancing material is phosphorescent material. These materials emit a persistent glow upon exposure to short wavelength radiation. An example is USR Optinox Pigment 2330 Green Phosphorescent particulate. The phosphorescent material contributes to the nighttime visibility of the garment wearer.

Note that the different types of visibility enhancing material can be combined, such as by incorporating fluorescent or phosphorescent pigments into a bead bond material in an exposed lens retroreflective layer. Another way of combining them is by patterning them in overlapping and/or non-overlapping configurations.

Figure 4:
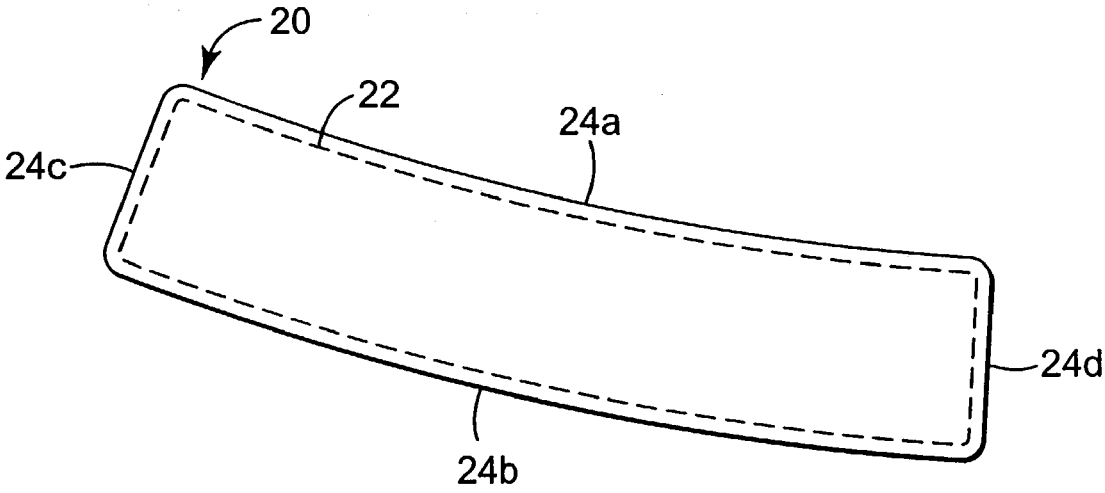
FIG. 4 is a view of one outer fabric panel.

Turning now to FIG. 4, we see there an outer fabric panel 20 that has been cut from a larger piece of fabric. The panel 20 will be stitched to other panels at one or more of edges 24*a–d*. A small portion of the fabric proximate such edges will typically be hidden from view and not form part of the outer surface of the garment, depending upon the type of stitch employed. The portion that remains exposed to viewing is the working surface 22.

At least 50% of the working surface 22 has applied directly to it a visibility enhancing material. Alternatively, at least 75% of the working surface 22 has applied directly to it a pattern of visibility enhancing material. The pattern may have a relatively low average area coverage of visibility enhancing material. Thermal decay and vapor permeability properties of the original outer fabric material can be beneficially retained if at least 20%, 25%, or 50% of the pattern is made up of background portions having no visibility enhancing material. For visibility purposes, it may be beneficial to limit the amount of untreated background portions to no more than about 80% in some embodiments.

Figure 5:
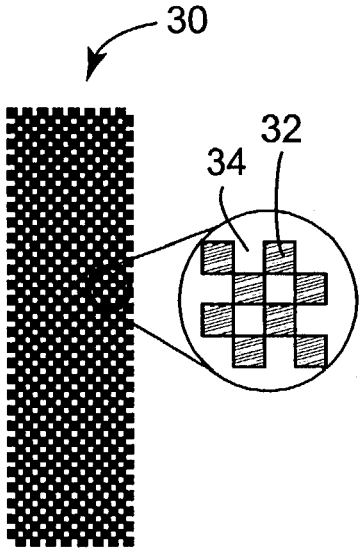
FIGS. 5–8 illustrate exemplary patterns of visibility enhancing material that include untreated background portions.
Figure 6:
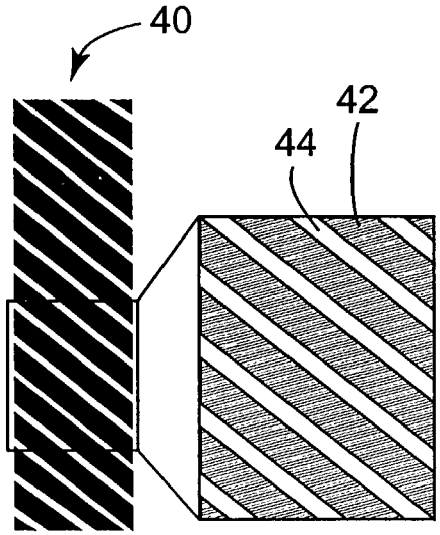
Figure 7:
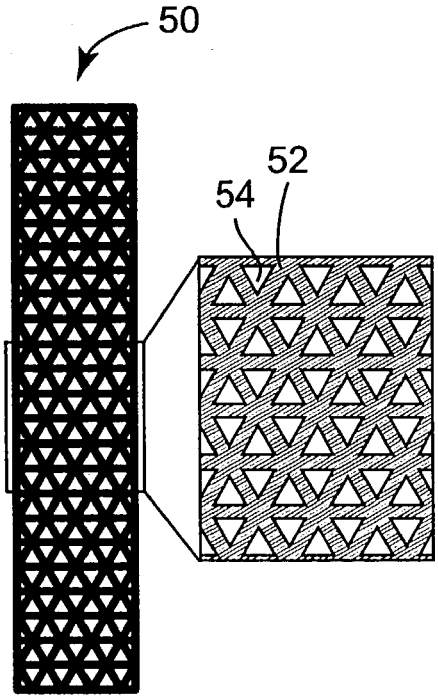
Figure 8:
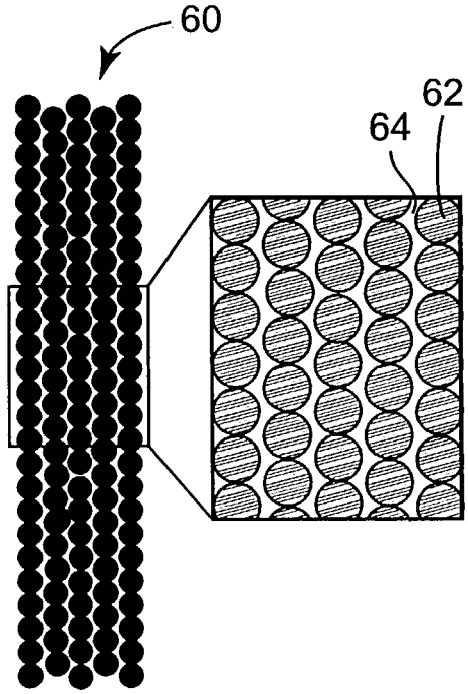

FIGS. 5–8 show exemplary patterns that incorporate such untreated background portions. In FIG. 5, pattern 30 includes visibility enhancing material applied selectively to treated portions 32, with background portions 34 being untreated. The treated and untreated portions form a checkerboard-like configuration having about 50% coverage of visibility enhancing material. In one embodiment, the individual squares have sides measuring about 0.3175 cm, for an area (per square) of substantially less than 1 $cm^2$. Other percent coverages, sizes, and aspect ratios are contemplated. In FIG. 6, pattern 40 includes visibility enhancing material applied selectively to treated portions 42, with background portions 44 being untreated. The treated and untreated portions form a stripe-like configuration. In one embodiment, this configuration has about 66% coverage of visibility enhancing material. In one case, the background portions are about 0.3175 cm wide and the treated portions are about 0.635 cm wide. Other percent coverages and stripe widths are contemplated. In FIG. 7, pattern 50 includes visibility enhancing material applied selectively to treated portions 52, with background portions 54 being untreated. The treated and untreated portions form one type of triangle-shaped configuration. In one embodiment, this configuration has about 75% coverage of visibility enhancing material. Another embodiment provides about 50% coverage. Other percent coverages are also contemplated. In FIG. 8, pattern 60 includes visibility enhancing material applied selectively to treated portions 62, with background portions 64 being untreated. The treated and untreated portions form one type of circular-shaped configuration.

Figure 9:
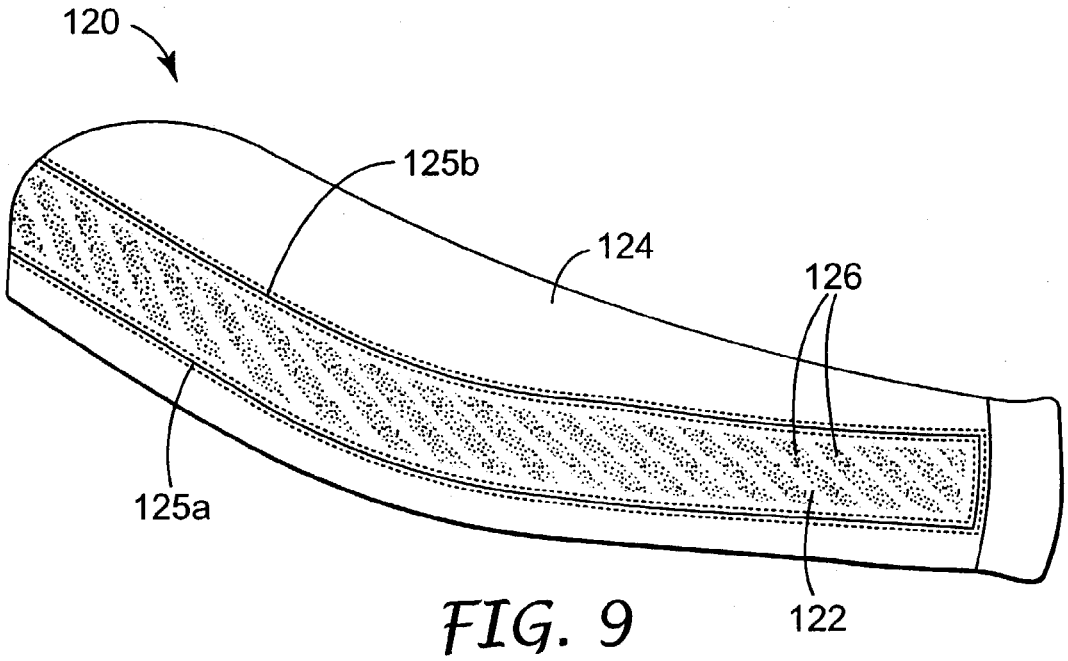
FIG. 9 is a representation of one embodiment of an extremity (such as an arm or leg) of a protective garment in accordance with the present specification.

Turning now to FIG. 9, an extremity portion 120 of a firefighter's garment is shown. The extremity portion 120 can be an arm portion, in the case of a jacket, or a leg portion, in the case of protective pants. The extremity portion 120 has an outer fabric shell comprising a enhanced visibility panel 122 and an adjacent panel 124. Panel 124, which can have little or no visibility-enhancing material applied thereto, wraps most of the way around the extremity portion and attaches to panel 122 along attachment lines 125*a*, 125*b*. Alternatively, panel 124 can itself be composed of two distinct panels connected together. In that way the extremity portion is made up of three outer fabric panels, one of which is reserved for visibility-enhancing purposes and two of which are not. Attachment of panel 124 to panel 122 is preferably by a mechanism that is robust enough so that separation of the panels does not occur in normal use, but that is also capable of being removed or reversed such that the panels can be separated from each other along the attachment lines. Such a semi-permanent attachment is provided by a conventional threaded stitch forming a seam. The seam is nominally permanent, but can be undone in a repair environment by carefully cutting the stitching thread. Preferably the seam is of the type that leaves no free edges of either panel exposed, so that catching or snagging problems can be avoided.

Visibility-enhancing panel 122, as indicated, has visibility-enhancing material 126 applied directly and permanently to the protective fabric over at least half, alternatively over at least 75%, of its working surface. Alternatively the pattern of visibility enhancing material is applied to at least 75% of the working surface of panel 122. The working surface in the embodiment of FIG. 9, similar to FIG. 4, is elongated to extend along the length of the extremity to provide full visibility thereof from some observation directions. The visibility-enhancing material on the panel 122 can consist essentially of only retroreflective material, or only fluorescent material, or only phosphorescent material. Alternatively, any two or all three of these materials can be combined on a single panel. In any case, the visibility-enhancing material and the underlying protective fabric of the panel form an enduring, intimate bond. At the same time, the visibility-enhancing material is thin enough that it does not add an excessive amount to the weight of the fabric, nor substantially detract from its flexibility. Existing fire-resistant fabrics used in firefighting garments weigh from about 0.02 to about 0.025 g/cm$^2$. The visibility-enhancing material preferably adds no more than about 0.04, 0.03, or most preferably 0.02 g/cm$^2$ of weight for a 100% coverage pattern. (The weight for smaller percent coverages is scaled accordingly. Thus, a 50% coverage pattern preferably adds no more than about 0.02, 0.015, or 0.01 g/cm$^2$.) By comparison, conventional visibility-enhancing fire trim products (incorporating a retroreflective stripe between two fluorescent stripes) weigh about 0.05 g/cm$^2$. As shown in FIG. 9, the material 126 can be applied in a patterned fashion analogous to printing, leaving a network of untreated fabric (background portions) between the printed or treated portions. Untreated fabric between printed stripes can promote the movement of moisture through the panel.

Figure 10:
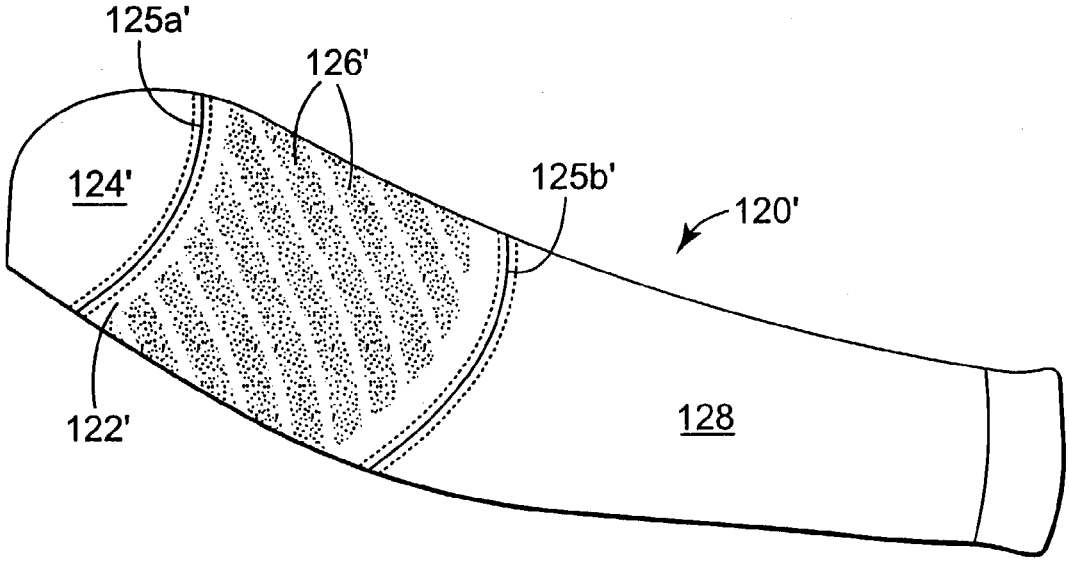
FIG. 10 is a representation of another embodiment of an extremity of a protective garment in accordance with the present specification.

In FIG. 10, another extremity portion 120' of a firefighter's garment is shown, analogous to that of FIG. 9. The enhanced visibility panel 122', however, is in the form of a band encircling the extremity portion, rather than a strip extending along the extremity portion. Threaded stitches semi-permanently connect panel 122' to its adjacent panels 124', 128, which contain no visibility enhancing material. Note that the embodiment of FIG. 10 can be easily modified to incorporate multiple band-type panels, just as the FIG. 9 embodiment can be modified to incorporate multiple strip-type panels. Band- and strip-type panels can also both be incorporated into a single garment.

Figure 11:
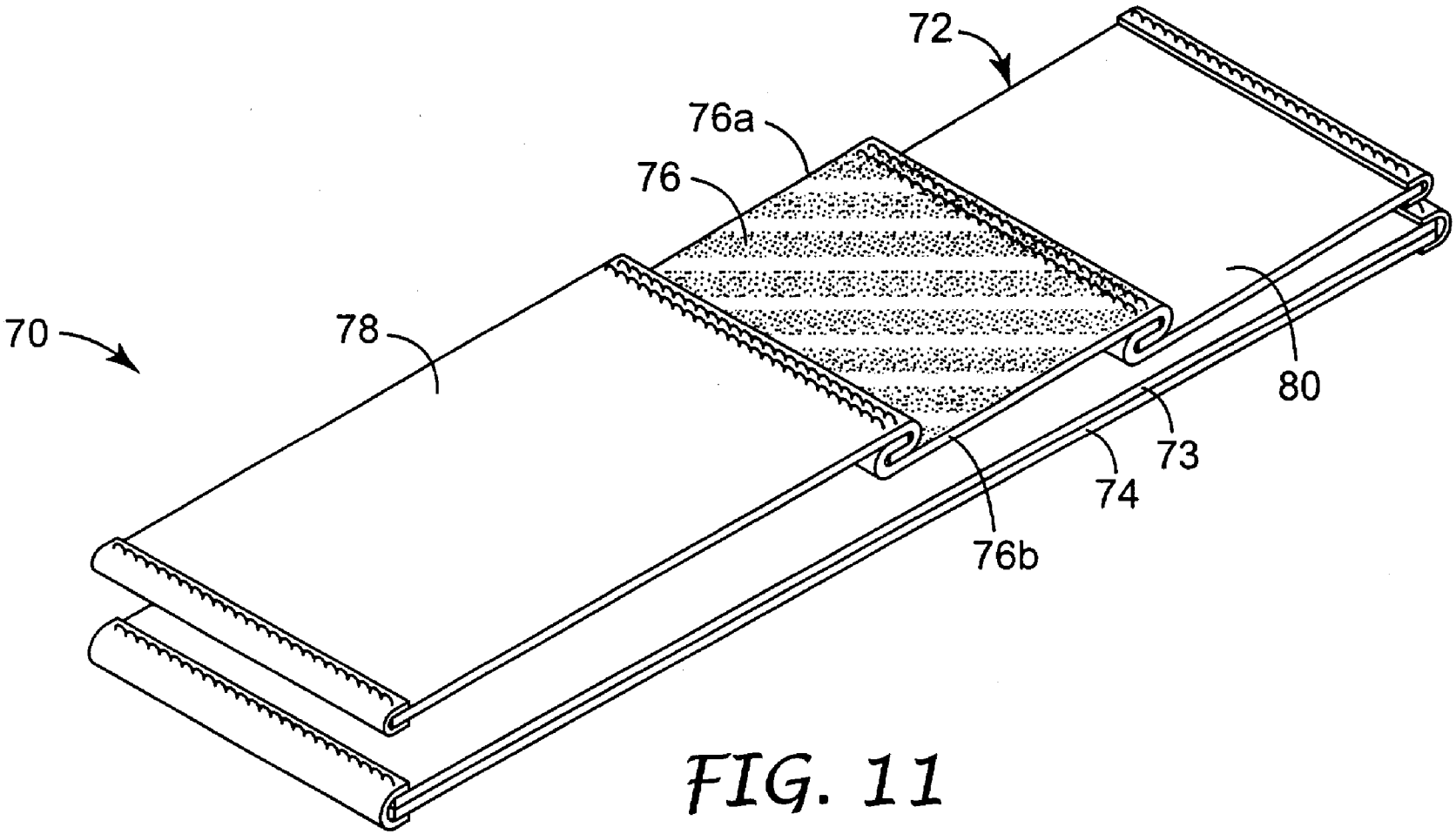
FIG. 11 is a cut-away perspective view of a portion of a protective garment, showing an enhanced visibility panel stitched to non-enhanced visibility panels.

FIG. 11 shows a broken-away perspective view of a portion of a garment 70 including an outer shell layer 72 and inner layers 73, 74. The outer shell comprises an enhanced visibility panel 76 and two non-enhanced visibility panels 78, 80. The panel 76 has opposed first and second edges 76*a*, 76*b* and opposed third and fourth edges (not labeled). Panels 76, 78, 80 attach to each other at respective edges thereof and are substantially non-overlapping, even though some overlap of the panels may occur in the seam areas and even though edges of adjacent panels are not in precise registration. As seen from the figure, each of the panels 76, 78, 80 are structural components of the outer shell material.

Figure 12A:
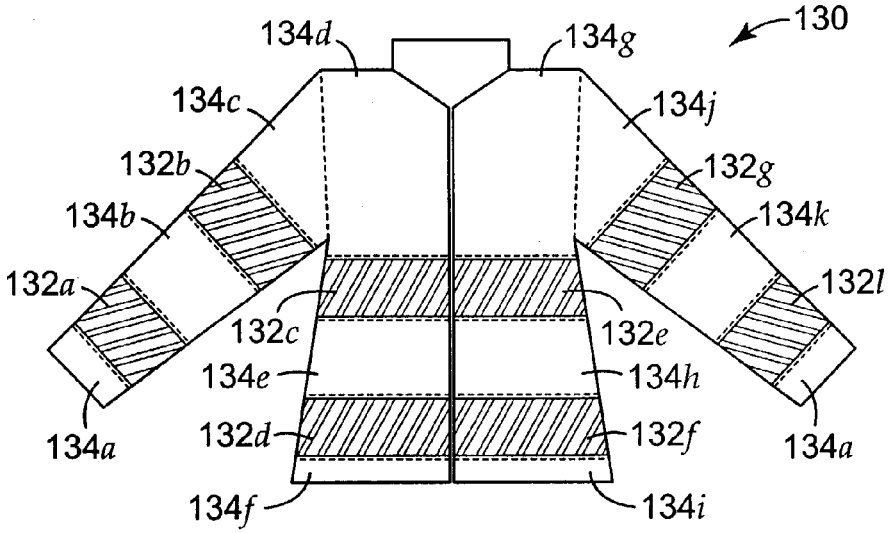
FIGS. 12 and 13 are views of a firefighter's jacket and protective pants, respectively, incorporating visibility-enhancing panels as described herein.
Figure 12B:
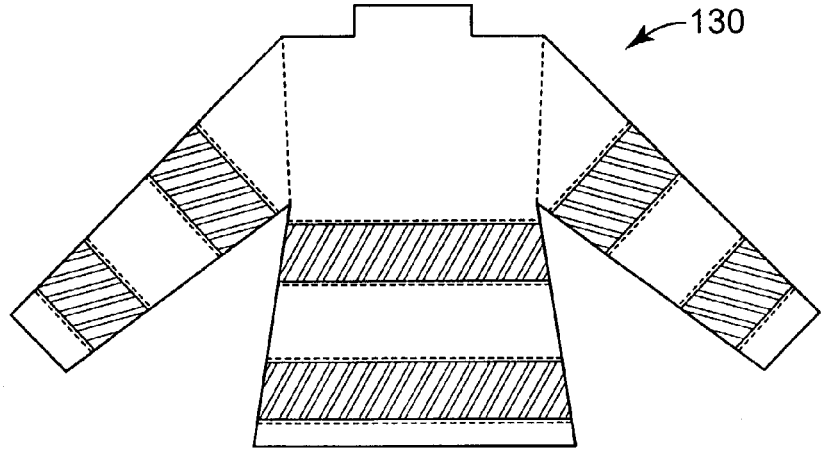
Figure 13:
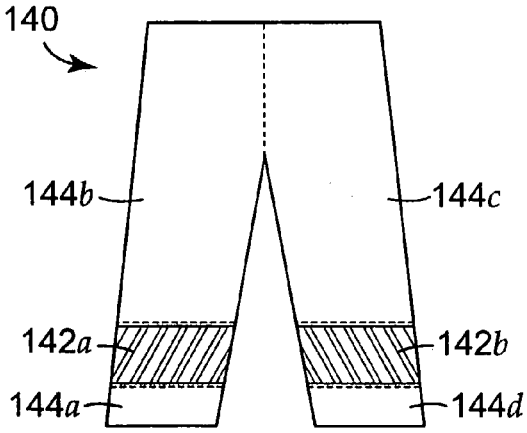

Turning now to FIGS. 12–13, we see there a firefighter's coat 130 and pants 140 incorporating into the construction of the outer shells thereof enhanced visibility panels as described above. FIG. 12*a* shows a front view of coat 130, and FIG. 12*b* shows a rear view. The enhanced visibility panels 132*a*–*h*, 142*a*–*b* were produced by treating a large piece or roll of flame-resistant fabric with suitable patterns of visibility-enhancing materials, and then cutting smaller pieces defining the visibility-enhancing panels from the larger material. Alternatively, the visibility enhancing feature(s) could be applied to the individual panels piece-wise after the panel is trimmed to shape. The remaining panels 134*a*–*l* and 144*a*–*d* were cut from the same type of flame-resistant fabric, but untreated with visibility-enhancing materials. The panels were then attached at their respective edges by stitching as shown to form the finished outer shell of the garment. In one embodiment, silver colored retroreflective panels are attached in this manner to the forearms, upper arms, jacket chest, jacket back, jacket hem, and pant cuffs. The repairable retroreflective panels can be, for example, about four inches wide with an aggregate length of about 150 inches, resulting in a total reflective area of about 400 in$^2$ from a 66% density diagonal stripe pattern. The visibility enhancing material on the panel can consist essentially of only retroreflective material, or only fluorescent material, or only phosphorescent material. Alternatively, patches of any two or all three of these materials can be combined on a single panel.

In the event one or more visibility-enhanced portions the garment become damaged, the coat is sent to a repair facility, where affected panels are replaced. For example, if panel 132*g* is damaged, the stitching connecting it to panels 134*j*, 134*k* is carefully cut and removed, and a replacement panel identical to the original panel 132*g* is stitched back in place. During the repair process, other non-visibility-enhancing panels may also be replaced, as well as inner layers of the garment.

All patents and patent applications referenced herein are incorporated by reference in their entirety. Various modifications and alterations of this invention will be apparent to those skilled in the art without departing from the scope and spirit of this invention, and it should be understood that this invention is not limited to the illustrative embodiments set forth herein. For example, the techniques described above can be applied to protective garments other than firefighter's garments.

What is claimed is:

1. A repairable protective garment, comprising an outer fabric layer composed of a plurality of distinct outer fabric panels, such plurality of panels including at least a first enhanced visibility panel stitched to a first non-enhanced visibility panel along respective edges thereof such that the first enhanced visibility panel and the first non-enhanced visibility panel are substantially non-overlapping, the first enhanced visibility panel having a working surface to which is applied directly and permanently over at least 75% of its area a pattern of visibility enhancing material.

2. The garment of claim 1, wherein the pattern includes background portions having no visibility enhancing material.

3. The garment of claim 1, wherein the background portions account for at least 25% of the pattern.

4. The garment of claim 3, wherein the background portions account for at least 50% of the pattern.

5. The garment of claim 1, wherein the pattern is selected from the group consisting of stripes, dots, and a checkerboard pattern.

6. A repairable protective garment, comprising an outer fabric layer composed of a plurality of distinct outer fabric panels, such plurality of panels including at least a first enhanced visibility panel stitched to a first non-enhanced visibility panel along respective edges thereof such that the first enhanced visibility panel and the first non-enhanced visibility panel are substantially non-overlapping, the first enhanced visibility panel having a working surface to which is applied directly and permanently over at least 50% of its area a visibility enhancing material.

7. The garment of claim 6, wherein the visibility enhancing material is applied to the working surface in a pattern.

8. The garment of claim 1 or 6, wherein the visibility enhancing material is applied to the working surface in a form selected from the group consisting of a thin surface coating and threads woven into the working surface.

9. The garment of claim 1 or 6, wherein the visibility enhancing material is selected from the group consisting of a retroreflective material, a fluorescent material, a phosphorescent material, and combinations thereof.

10. The garment of claim 1 or 6, wherein the outer fabric layer comprises a fire-resistant fabric.

11. The garment of claim 1 or 6, wherein the first enhanced visibility panel is elongated into a strip.

12. The garment of claim 11, wherein the strip is in the form of a band.

13. The garment of claim 1 or 6, wherein the plurality of panels further includes a second non-enhanced visibility panel.

14. The garment of claim 13, wherein the first enhanced visibility panel has opposed first and second edges, and the first enhanced visibility panel attaches to the first non-enhanced visibility panel along the first edge and attaches to the second non-enhanced visibility panel along the second edge.

15. The garment of claim 14, wherein the first enhanced visibility panel further has opposed third and fourth edges, and the first enhanced visibility panel attaches to itself along the third and fourth edges to form a band.

16. The garment of claim 14, wherein the first enhanced visibility panel and the first and second non-enhanced visibility panels form at least a portion of an extremity member of the garment selected from the group consisting of an arm and a leg.

* * * * *